US005749711A

United States Patent [19]

Park

[11] Patent Number: 5,749,711

[45] Date of Patent: May 12, 1998

[54] AUTOMATIC PNEUMATIC PUMP INCLUDING A TANK WITH INLET AND OUTLET AND A PUMP CONNECTED TO THE INLET

[76] Inventor: Sae Joon Park, 175-20, Sadang 3-dong, Dongjak-ku, Seoul, Rep. of Korea, 156-093

[21] Appl. No.: 784,531

[22] Filed: Dec. 24, 1996

[30] Foreign Application Priority Data

May 13, 1995 [KR] Rep. of Korea ..... 1955/11798

[51] Int. Cl.[6] ..... F04F 1/02; E03F 5/22; E03F 1/00; B67D 5/54

[52] U.S. Cl. ..... 417/120; 417/138

[58] Field of Search ..... 417/120, 138, 417/143, 144, 145, 149

[56] References Cited

U.S. PATENT DOCUMENTS

| | | | |
|---|---|---|---|
| 2,669,941 | 2/1954 | Stafford | 417/138 X |
| 2,725,825 | 12/1955 | Cibattari | 417/120 |
| 3,930,755 | 1/1976 | Lahr et al. | 417/120 |
| 4,021,147 | 5/1977 | Brekke | 417/138 |
| 4,304,527 | 12/1981 | Jewell et al. | 417/138 X |
| 5,074,758 | 12/1991 | McIntyre | 417/138 |

*Primary Examiner*—Timothy Thorpe
*Assistant Examiner*—Ted Kim
*Attorney, Agent, or Firm*—Shlesinger Arkwright & Garvey LLP

[57] ABSTRACT

An automatic pneumatic pump preferably used with a waste water disposal system is disclosed. The pump forcibly introduces sludge-laden liquid into a tank (30) and in turn feeds the liquid to a filter unit (F) for filtering off the sludge. The pump has one air pressure pipe (61) and two air exhaust pipes (62, 63) provided to the upper portion of the tank (30). The air pipes (61 to 63) include their solenoid valves (71 to 73) which are selectively opened in accordance with the liquid level inside the tank (30). An air compressor (C) is mounted to the air pressure pipe (61) and selectively operated during a time when the liquid level inside the tank (30) reduces from a top level to a bottom level ($S_1$). A vacuum pump ($P_2$) is mounted to the second air exhaust pipe (63) and selectively operated during a time when the liquid level inside the tank (30) increases from the bottom level (S1) to the top level ($S_2$). A microcomputer controls the solenoid valves, air compressor, vacuum pump and liquid pump in response to signals output from liquid level and pressure sensing units.

1 Claim, 1 Drawing Sheet

FIG.
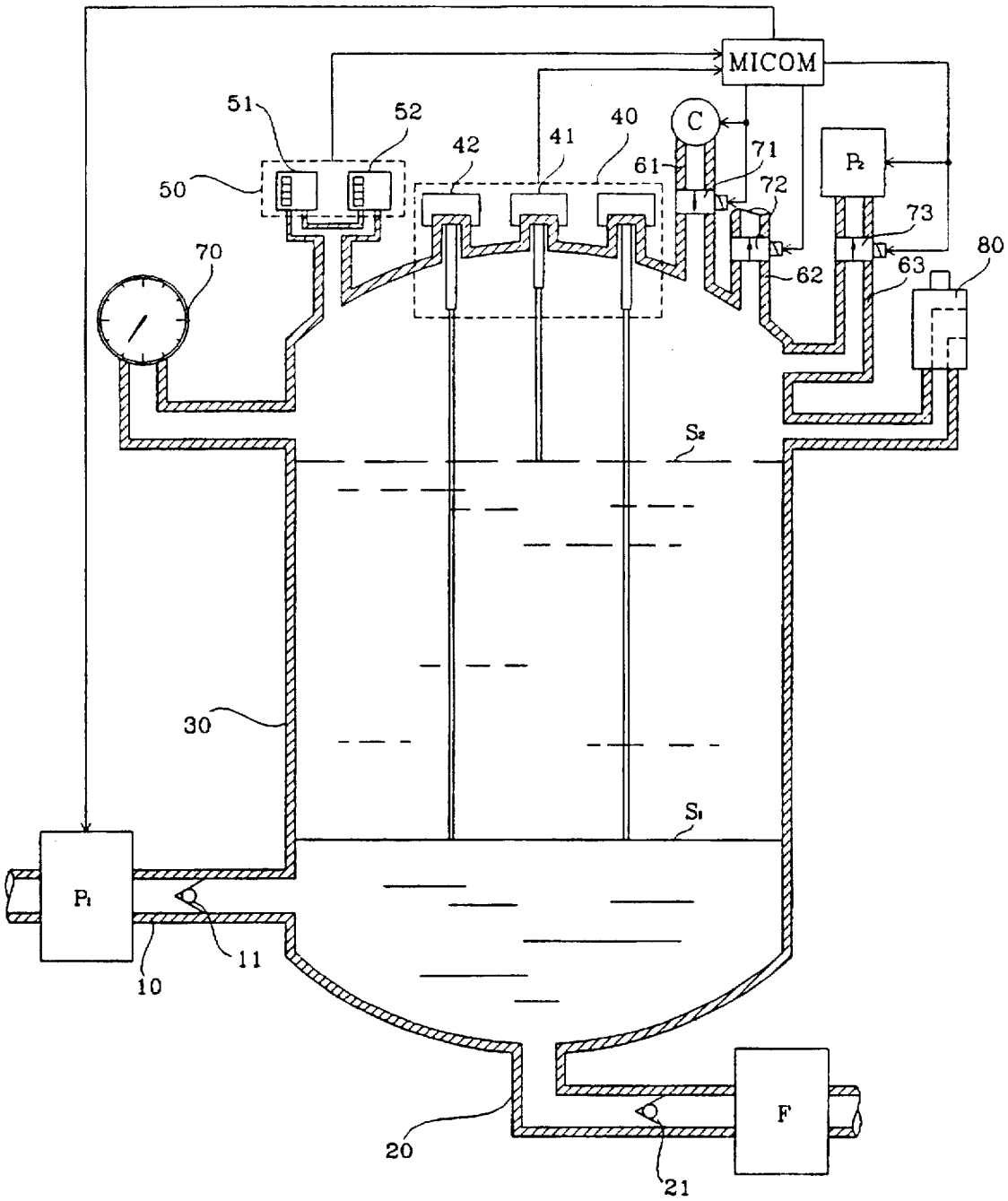

AUTOMATIC PNEUMATIC PUMP INCLUDING A TANK WITH INLET AND OUTLET AND A PUMP CONNECTED TO THE INLET

This application is a continuation of PCT/KR96/00072 filed May 10, 1996.

TECHNICAL FIELD

The present invention relates in general to pneumatic pumps and, more particularly, to an automatic pneumatic pump used for forcibly introducing sludge-laden waste liquid, such as waste water or industrial wastes, into a tank and in turn supplying pressurized air into the tank at a time the tank has been filled with a predetermined amount of liquid, thereby forcibly discharging the liquid outside the tank while filtering off the sludge.

BACKGROUND ART

In typical waste water disposal systems, waste water is pumped up and forcibly fed to a filter unit where the sludge in the waste water is filtered off. In order to pump up the sludge-laden waste water, the typical waste water disposal systems are provided with pumps. In the operation of the above systems, the viscous sludge in waste water may stick to the filter unit and thereby cause an operational problem in the filter unit. In this regard, the sludge-laden waste water in the above systems has been pumped up by an impeller, piston or vane type pump to be highly pressurized while being fed to the filter unit. However, the waste water under pressure applies high pressure to the filter unit thus causing damage in the filter unit. In addition, the pump may be overloaded during such a high pressure pumping operation, so the pump regrettably generates operational noises. Another problem of the above pump resides in that the lubrication oil supplied to the drive part of the pump may leak from the pump and go into the waste water.

DISCLOSURE OF THE INVENTION

It is, therefore, an object of the present invention to provide an automatic pneumatic pump in which the above problems can be overcome and which forcibly introduces sludge-laden waste liquid to a tank while controlling the air pressure inside the tank and in turn feeds the liquid to a filter unit for discharging the liquid while filtering off the sludge in the liquid. The above pump selectively stops its operation at a time the air pressure inside the tank is not lower than a predetermined pressure, thus causing neither oil leakage from the drive part of the pump into the liquid nor damage in the filter unit due to the pressurized liquid.

In order to accomplish the above object, an automatic pneumatic pump in accordance with a preferred embodiment of the present invention comprises a liquid tank for receiving liquid therein. The lower portion of the above tank has a liquid inlet pipe and liquid outlet pipe, while the upper portion of the tank has an air pressure pipe and first and second air exhaust pipes. A pair of sensing units are provided in the tank and sense liquid level and air pressure inside the tank, respectively. A plurality of solenoid valves are mounted to the air pressure and exhaust pipes, respectively. The above solenoid valves are selectively opened to open the air pressure and exhaust pipes in accordance with the liquid level inside the tank. A pair of check valves are mounted to the liquid inlet and outlet pipes, respectively. An air compressor is mounted to the air pressure pipe. The air compressor is selectively operated during a time the liquid level inside the tank reduces from a predetermined top level to a predetermined bottom level. The above pump also includes a vacuum pump which is mounted to the second air exhaust pipe. The above vacuum pump is selectively operated during a time when the liquid level inside the tank increases from the bottom level to the top level. A liquid pump is connected to the liquid inlet pipe. The liquid pump feeds the liquid into the tank through the liquid inlet pipe. A microcomputer controls the solenoid valves, air compressor, vacuum pump and liquid pump in response to signals output from the sensing units.

BRIEF DESCRIPTION OF THE DRAWING

The above and other objects, features and other advantages of the present invention will be more clearly understood from the following detailed description taken in conjunction with the accompanying drawing, which is a sectional view showing the construction of a waste liquid disposal system with the automatic pneumatic pump in accordance with a preferred embodiment of the present invention.

BEST MODE FOR CARRYING OUT THE INVENTION

The accompanying drawing is a sectional view showing the construction of a waste liquid disposal system with the automatic pneumatic pump in accordance with a preferred embodiment of the present invention.

As shown in the drawing, the pump of this invention includes a liquid tank 30 which includes a pair of liquid pipes, that is, liquid inlet and outlet pipes 10 and 20. The above pipes 10 and 20 are connected to the lower portion of the side wall of the tank 30. The upper portion of the above tank 30 is provided with three air pipes, that is, one air pressure pipe 61 and two air exhaust pipes 62 and 63. A liquid pump $P_1$ is mounted to the above liquid inlet pipe 10. The liquid pump $P_1$ pumps up sludge-laden waste liquid to fill the liquid in the tank 30. Set in the liquid inlet pipe 10 is a first check valve 11 which checks the liquid in order to prevent the liquid from flowing backward from the tank 30 to the pump $P_1$. Meanwhile, the liquid outlet pipe 20 is provided with a filter unit F and second check valve 21. The above filter unit F filters off the sludge in the waste liquid while the liquid passes through the filter unit F to be discharged from the tank 30. The second check valve 21 checks the liquid in order to prevent the liquid from flowing backward from the filter unit F to the tank 30.

The air pressure and exhaust pipes 61 to 63 are provided with solenoid valves 71 to 73, respectively. Connected to the above air pressure pipe 61 is an air compressor C which supplies pressurized air into the tank 30. A vacuum pump $P_2$ is connected to the second air exhaust pipe 63. The above vacuum pump $P_2$ forcibly discharges the pressurized air from the tank 30 into the atmosphere.

The above automatic pneumatic pump also includes a liquid level sensing unit 40. The above sensing unit 40 which is mounted to the upper portion of the tank 30 senses the liquid level inside the tank 30 and outputs a liquid level signal to a microcomputer which will be described later herein. The above level sensing unit 40 includes two sensors, that is, top and bottom level sensors 41 and 42. The top level sensor 41 senses a predetermined top level $S_2$ of the waste liquid inside the tank 30, while the bottom level sensor 42 senses a predetermined bottom level $S_1$ of the waste liquid inside the tank 30.

The upper portion of the tank 30 also includes a pressure sensing unit 50 which senses the air pressure inside the tank 30 and outputs a pressure signal to the microcomputer. The above pressure sensing unit 50 includes a pair of sensors, that is, low and high pressure sensors 51 and 52. A pressure gauge 70, which indicates the air pressure inside the tank 30, is mounted to the side wall of the tank 30. In order to selectively manually discharge the pressurized air from the tank 30 as desired, a manual air discharge valve 80 is mounted to the side wall of the tank 30.

The above pneumatic pump is automatically controlled by the microcomputer (MICOM). The above microcomputer receives the signals output from the sensing units 40 and 50 and selectively opens the solenoid valve 72 in the first air exhaust pipe 62 when the liquid inside the tank 30 has reached the bottom level $S_1$. The microcomputer in the above state also selectively opens the solenoid valve 73 in the second air exhaust pipe 63, while operating the vacuum pump $P_2$, thus allowing the liquid to be introduced into the tank 30. When the liquid inside the tank 30 has reached the top level $S_2$, the microcomputer closes the solenoid valves 72 and 73 and stops the pumps $P_1$ and $P_2$. Thereafter, the microcomputer opens the solenoid valve 71 in the air pressure pipe 61 prior to starting the air compressor C. Thus, the pressurized air is introduced into the tank 30 and discharges the liquid inside the tank 30 from the tank 30 through the liquid outlet pipe 20 with the filter unit F. When the air pressure inside the tank 30 is not lower than a predetermined pressure level, the microcomputer stops the operation of the above pneumatic pump thereby preventing damage in the filter unit F due to the highly-pressurized liquid discharged through the filter unit F.

The operational effect of the above pneumatic pump will be described hereinbelow.

In the operation of the above pneumatic pump, the liquid pump $P_1$ is started to forcibly introduce the sludge-laden waste liquid into the tank 30 through the liquid inlet pipe 10. The liquid inside the tank 30 in turn is discharged from the tank 30 through the liquid outlet pipe 20 with the filter unit F. The filter unit F in the above state filters off the sludge in the waste liquid thereby purifying the liquid. As the sludge sticks to the filter unit F, the amount of liquid passing through the filter unit F gradually reduces, while the amount of liquid in the tank 30 gradually increases. When the liquid level inside the tank 30 has reached the bottom level $S_1$ as a result of an increase of the level of liquid caused by reduced flow, the solenoid valve 72 in the first air exhaust pipe 62 is opened under the control of the microcomputer, thus causing the air inside the tank 30 to be exhausted into the atmosphere through the first air exhaust pipe 62. In order to let the waste liquid rapidly flow into the tank 30 in the above state, the microcomputer opens the solenoid valve 73 in the second air exhaust pipe 63 simultaneously while starting the vacuum pump $P_2$, thus bringing the air pressure inside the tank 30 to a negative pressure condition.

When the liquid level inside the tank 30 has reached the top level $S_2$ as a result of a further increase of the level, the microcomputer stops the pumps $P_1$ and $P_2$ and closes the solenoid valves 72 and 73 while opening the other solenoid valve 71. The microcomputer in the above state also starts the air compressor C, thus supplying pressurized air into the tank 30 through the air pressure pipe 61. The liquid inside the tank 30 is thus forcibly discharged from the tank 30 through the liquid outlet pipe 20. The liquid in the above state passes through the filter unit F in the pipe 20, so the sludge in the liquid is filtered off. When the liquid level inside the tank 30 has reached the bottom level $S_1$ as a result of a reduction of the level, the microcomputer stops the air compressor C and closes the solenoid valve 71 prior to repeating the above-mentioned process.

When the air pressure inside the tank 30 is not lower than a predetermined pressure, the above pneumatic pump stops its operation under the control of the microcomputer, thus protecting the filter unit F. The microcomputer in the above state also opens the air discharge valve 80 to discharge the air from the tank 30, thereby protecting the pneumatic pump.

Industrial Applicability

In the above description, the automatic pneumatic pump according to the present invention is used with, for example, a waste liquid disposal system. However, it should be understood that the above pneumatic pump may be used with a high pressure water pumping system such as a water supply system for many-storied buildings.

I claim:

1. An automatic pneumatic pump comprising:

a liquid tank for receiving liquid therein, said tank having a liquid inlet pipe, liquid outlet pipe, air pressure pipe and first and second air exhaust pipes, said liquid inlet and outlet pipes being provided on a lower portion of said tank, while said air pressure and exhaust pipes being provided on an upper portion of said tank;

a pair of sensing units provided in said tank and adapted for sensing liquid level and air pressure inside said tank, respectively;

a plurality of solenoid valves mounted to said air pressure and exhaust pipes, respectively, and selectively opened to open said air pressure and exhaust pipes in accordance with the liquid level inside said tank;

a pair of check valves mounted to said liquid inlet and outlet pipes, respectively;

an air compressor mounted to said air pressure pipe and selectively operated during a time when the liquid level inside said tank reduces from a predetermined top level to a predetermined bottom level;

a vacuum pump mounted to said second air exhaust pipe and selectively operated during a time when the liquid level inside said tank increases from said bottom level to said top level;

a liquid pump adapted for forcibly feeding the liquid into said tank through said liquid inlet pipe; and a microcomputer adapted for controlling said solenoid valves, air compressor, vacuum pump and liquid pump in response to signals output from said sensing units.

* * * * *